US009694939B1

(12) United States Patent
Hsieh

(10) Patent No.: US 9,694,939 B1
(45) Date of Patent: Jul. 4, 2017

(54) CONTAINER

(71) Applicant: Fu-Yu Hsieh, Taichung (TW)

(72) Inventor: Fu-Yu Hsieh, Taichung (TW)

( * ) Notice: Subject to any disclaimer, the term of this patent is extended or adjusted under 35 U.S.C. 154(b) by 0 days.

(21) Appl. No.: 15/050,434

(22) Filed: Feb. 22, 2016

(30) Foreign Application Priority Data

Dec. 25, 2015 (TW) ..... 104220819 U

(51) Int. Cl.
*B65D 23/10* (2006.01)
*B65D 43/02* (2006.01)
*B65D 71/50* (2006.01)

(52) U.S. Cl.
CPC ..... *B65D 23/108* (2013.01); *B65D 43/02* (2013.01); *B65D 71/50* (2013.01)

(58) Field of Classification Search
CPC .. B65D 43/0204; B65D 71/50; B65D 23/108; B65D 43/02
USPC ..... 229/148, 117.14; 215/228
See application file for complete search history.

(56) References Cited

U.S. PATENT DOCUMENTS

| | | | | |
|---|---|---|---|---|
| 2,004,188 A | | 6/1935 | Borberg | |
| 4,923,062 A | | 5/1990 | Hehn | |
| 5,685,478 A | * | 11/1997 | Tang | B65D 1/26 229/117.14 |
| 6,827,207 B1 | * | 12/2004 | Chen | B65D 71/50 206/162 |
| 2009/0139892 A1 | | 6/2009 | Vovan et al. | |
| 2010/0176129 A1 | | 7/2010 | Vovan et al. | |
| 2014/0262885 A1 | | 9/2014 | Green et al. | |

FOREIGN PATENT DOCUMENTS

| | | | |
|---|---|---|---|
| CN | 2841564 | Y | 11/2006 |
| CN | 200961028 | Y | 10/2007 |
| CN | 203682042 | U | 7/2014 |
| JP | S56-59510 | U | 5/1981 |
| JP | S60-96237 | U | 7/1985 |
| JP | 3 068824 | U | 5/2000 |
| JP | 2002-68347 | A | 3/2002 |
| JP | 2004-284595 | A | 10/2004 |
| TW | 242872 | | 3/1995 |
| TW | 424785 | | 3/2001 |

(Continued)

OTHER PUBLICATIONS

English Abstract of TW 242872.

(Continued)

*Primary Examiner* — Anthony Stashick
*Assistant Examiner* — Raven Collins
(74) *Attorney, Agent, or Firm* — Hershkovitz & Associates, PLLC; Abe Hershkovitz

(57) ABSTRACT

A container is in an integral form, and has a body, two handles, a handle combination structure, a folding combination structure, and two lids. The handles are connected with the body, and connecting portions between the handles and body are bendable. The handle combination structure is formed on the handles to selectively combine the handles. The folding combination structure is formed on the handles and the connecting plates to selectively combine the handles and the body. The lids are connected with the body, are respectively located in spaces which are respectively formed in the body and the handles, and connecting portions between the body and the lids are bendable.

7 Claims, 10 Drawing Sheets

(56) References Cited

FOREIGN PATENT DOCUMENTS

| | | |
|---|---|---|
| TW | 590107 | 6/2004 |
| TW | M439624 | 10/2012 |

OTHER PUBLICATIONS

English Abstract of TW 424785.
English Abstract of 590107.
English Abstract of M439624.
English language Abstract of CN 2841564 Y.
English language Abstract of CN 200961028 Y.
English language Abstract of CN 203682042 U.
English language Abstract of JP S56-59510 U.
English language Abstract of JP 2002-68347 A.
English language Abstract of JP 2004-284595 A.
European Search Report mailed by EPO on Mar. 23, 2017 for related European Patent Application No. 16 20 0840.3.

* cited by examiner

CONTAINER

BACKGROUND OF THE INVENTION

1. Field of the Invention

The present invention relates to a container, and more particularly to a container which can be assembled easily.

2. Description of Related Art

With reference to FIG. 10, a conventional container comprises a body 81 and a lid 82 detachably mounted on the body 81. The body 81 and the lid 82 are made of plastic, and may be manufactured by a vacuum forming machine or a pressure forming machine. When the conventional container is made by the vacuum forming machine, a plastic plate is placed on a mold and heated. The mold is in a vacuum state, and the heated plastic is sucked on the mold and is formed into a shape matching the mold. When the conventional container is made by the pressure forming machine, a plastic is heated and blown on a mold to form a shape matching the mold.

Whatever machine the conventional container is made by, the conventional container comprises the individual body 81 and the individual lid 82. The body 81 and the lid 82 need to be manufactured individually. In use, after fruit is placed in the conventional container, a user needs to put the individual lid 82 on the body 81 to cover the body 81, and it is inconvenient for assembling the conventional container.

SUMMARY OF THE INVENTION

The main objective of the present invention is to provide a container to overcome the afore-mentioned problems.

The container is integral, and comprises a body, two handles, a handle combination structure, a folding combination structure, and two lids.

The body comprises a body space formed in the body.

The handles are connected with the body, and connecting portions between the handles and the body are bendable.

The handle combination structure is formed on the handles to selectively combine the handles.

The folding combination structure is formed on the handles and the connecting plates to selectively combine the handles and the body.

The lids are connected with the body, are respectively located in spaces which are respectively formed in the body and the handles, and connecting portions between the body and the lids are bendable.

Other objectives, advantages and novel features of the present invention will become more apparent from the following detailed description when taken in conjunction with the accompanying drawings.

DETAILED DESCRIPTION OF PREFERRED EMBODIMENT

Figure 1:
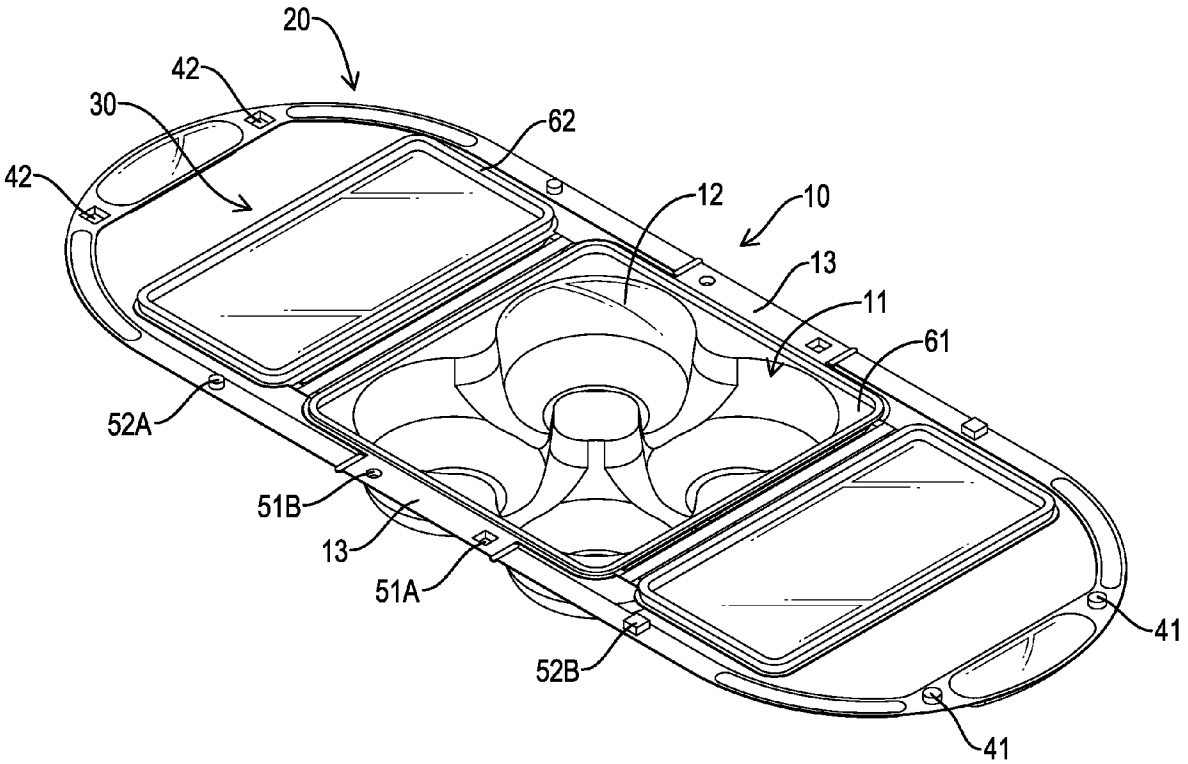
FIG. 1 is a perspective view of a first preferred embodiment of a container in accordance with the present invention.
Figure 2:
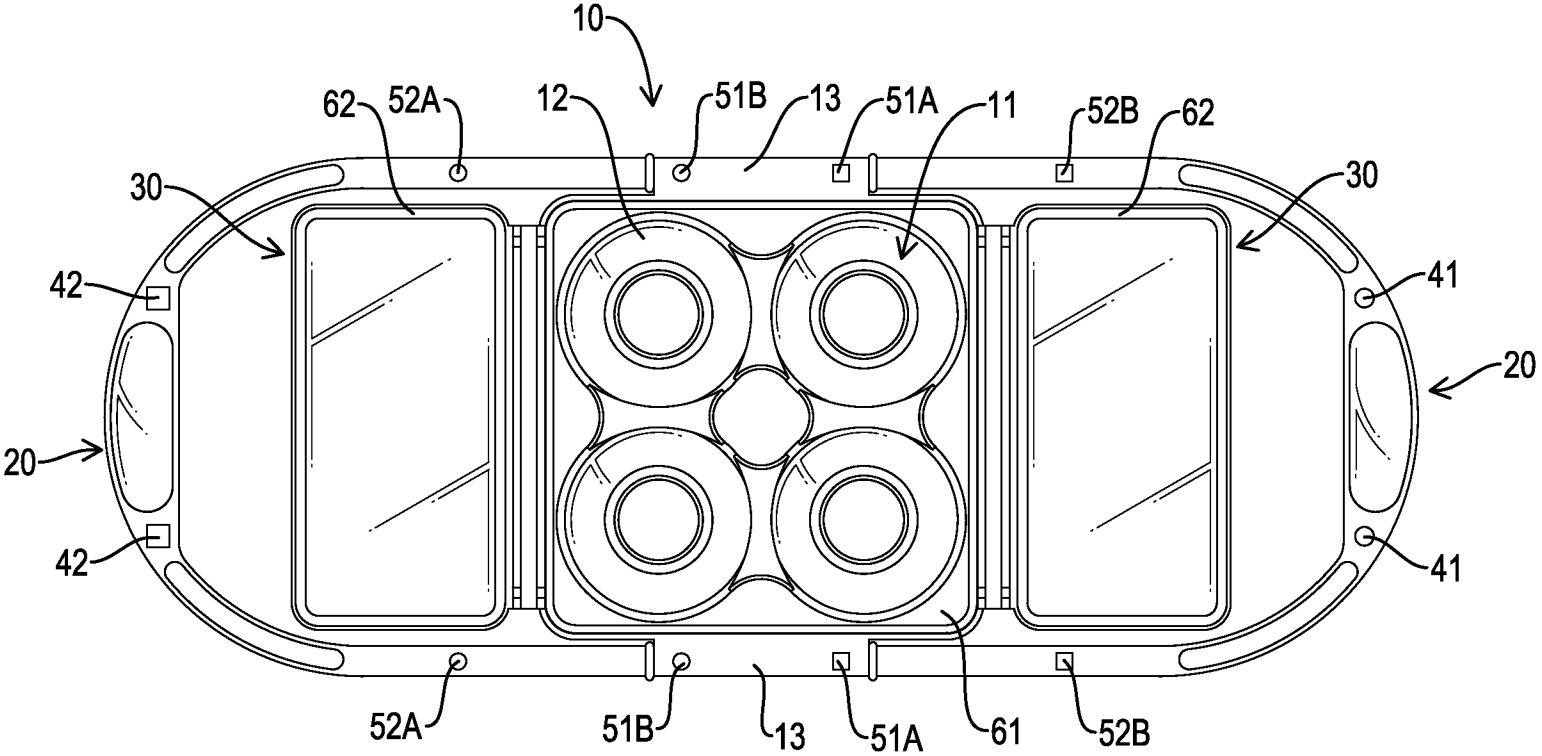
FIG. 2 is a top view of the container in FIG. 1.

With reference to FIGS. 1 and 2, a first preferred embodiment of a container in accordance with the present invention is formed as an integral form and comprises a body 10, two handles 20, and two lids 30.

The body 10 comprises a body space 11 formed in the body 10 and comprising multiple positioning recesses 12. Preferably, four positioning recesses 12 are implemented to be disposed symmetrically in the body space 11.

The handles 20 are connected with the body 10, and the connecting portions between the handles 20 and the body 10 are bendable. Preferably, the body 10 further comprises two connecting plates 13 formed on two opposite sides of the body 10. The handles 20 are U-shaped, and one of the handles 20 is connected with two right ends of the two connecting plates 13, and the other handle 20 is connected with two left ends of the two connecting plates 13.

A handle combination structure is formed on the handles 20, such that the handles 20 can be combined with each other by the handle combination structure. Preferably, the handle combination structure comprises two hand protrusions 41 formed on one of the handles 20, and two hand troughs 42 formed in the other handle 20. The handle protrusions 41 and the handle troughs 42 can be combined with each other respectively and selectively. As a result, after the handles 20 are bended relative to the body 10, the handle protrusions 41 and the handle troughs 42 can be combined with each other respectively to form a usage state of the container of the present invention.

A folding combination structure is formed on the handles 20 and the connecting plates 13. Preferably, the folding combination structure comprises two first plate combinational portions 51A, two second plate combinational portions 51B, two first handle combinational portions 52A, and two second handle combinational portions 52B. The first plate combinational portions 51A are respectively formed on the right ends of the two connecting plates 13. The second plate combinational portions 51B are respectively formed on the left ends of the two connecting plates 13. The first handle combinational portions 52A are formed on the handle 20 that is adjacent to the second plate combinational portions 51B. The second handle combinational portions 52B are formed on the handle 20 that is adjacent to the first plate combinational portions 51A. The first handle combinational portions 52A and the first plate combinational portions 51A are disposed equidistantly relative to the connecting portions which connect the connecting plates 13 and the handle 20 on which the first handle combinational portions 52A are formed. The second handle combinational portions 52B and the second plate combinational portions 51B are disposed equidistantly relative to the connecting portions which connect the connecting plates 13 and the handle 20 on which the second handle combinational portions 52B are formed. The first handle combinational portions 52A are selectively and respectively combined with the first plate combinational portions 51A. The second plate combinational portions 51B are selectively and respectively combined with the second handle combinational portions 52B. As a result, after the handles 20 are bended relative to the body 10, the first handle combinational portions 52A can be combined with the first plate combinational portions 51A, and the second handle combinational portions 52B can be combined with the second plate combinational portions 51B to form a folded usage state of the container of the present invention.

The lids 30 are connected with the body 10, and connecting portions between the body 10 and the lids 30 are bendable. The lids 30 are respectively located in spaces which are respectively formed between the body 10 and the handles 20.

A lid combination structure is formed on the lids 30 and the body 10. Preferably, the lid combination structure comprises an engaging portion 61 recessed in the body 10 and located at a top of the body 10 to form a top opening of the body 10, and two engaging flanges 62 are respectively formed on the lids 30. The engaging flanges 62 are selectively combined with the engaging portion 61.

Figure 3:
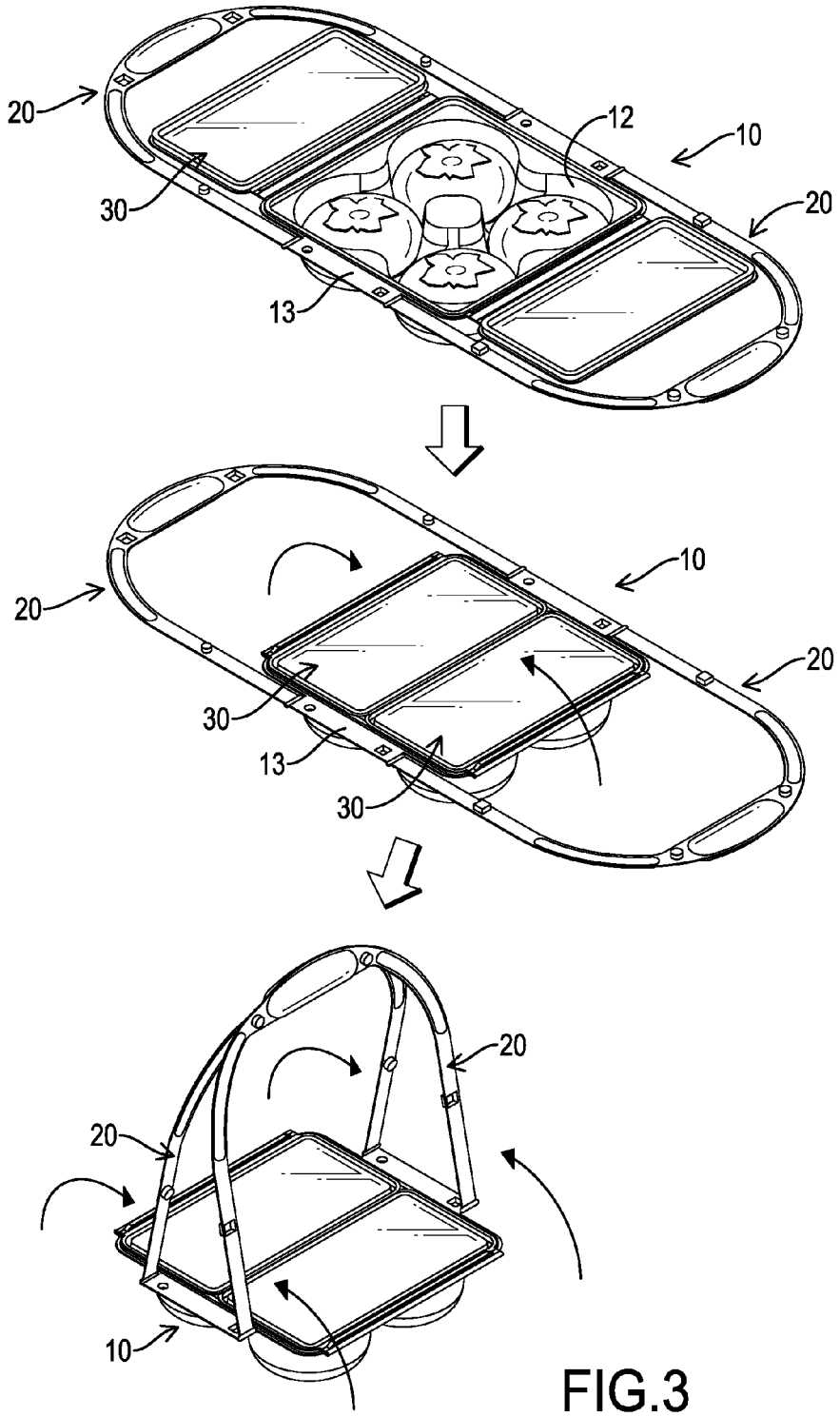
FIGS. 3 and 4 are operational views of the container in FIG. 1.

In use, with reference to FIG. 3, the body 10 is applied for containing fruit, especially apples, pears, or persimmons as shown in FIG. 3. The positioning recesses 12 are applied for positioning the fruit to keep the fruits from colliding with each other. The lids 30 are bended inwardly relative to the body 10, and are combined with the body 10 by the lid combination structure. As a result, the lids 30 can cover the body 10. Then, the handles 20 are bended inwardly relative to the body 10, and are combined with each other by the handle combination structure. Therefore, a user can hold the handles 20 to carry the container in which the fruit is placed.

Figure 4:
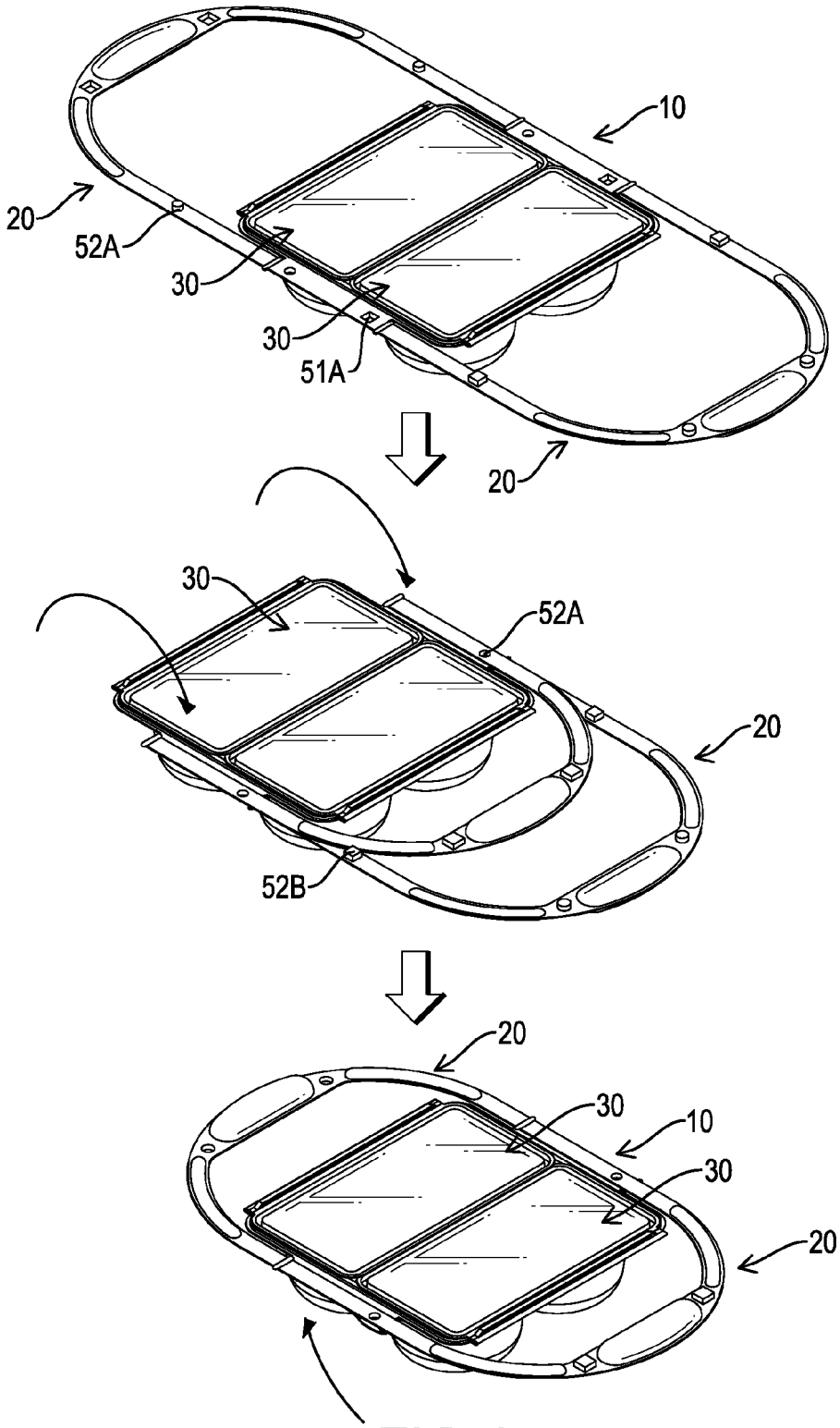
Figure 5:
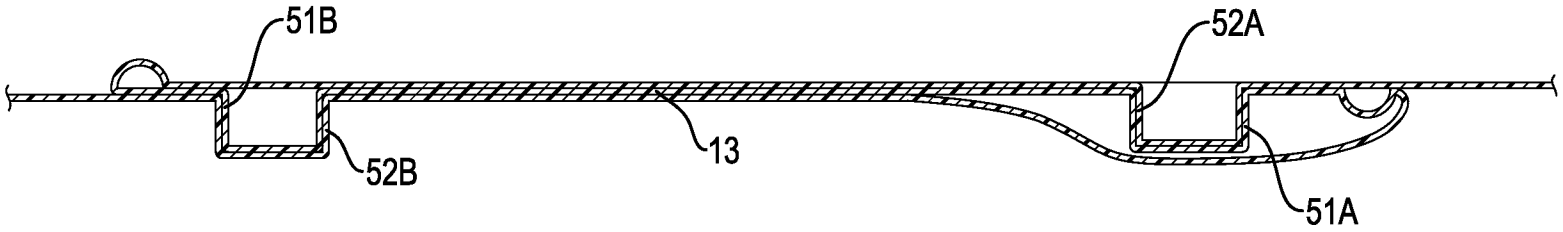
FIG. 5 is an enlarged cross sectional side view of the container in FIG. 1.

Alternatively, with reference to FIGS. 4 and 5, after the fruit is held in the body 10 and the lids 30 cover the body 10, the handles 20 can be passed over the body 10. One of the handles 20 is passed above the body 10 to combine with the body 10 by the folding combination structure, and the other handle is passed below the body 10 to combine with the body 10 by the folding combination structure. Therefore, the container is formed in the folded usage state to decrease a volume of the container for ease in stacking and storage.

Figure 6:
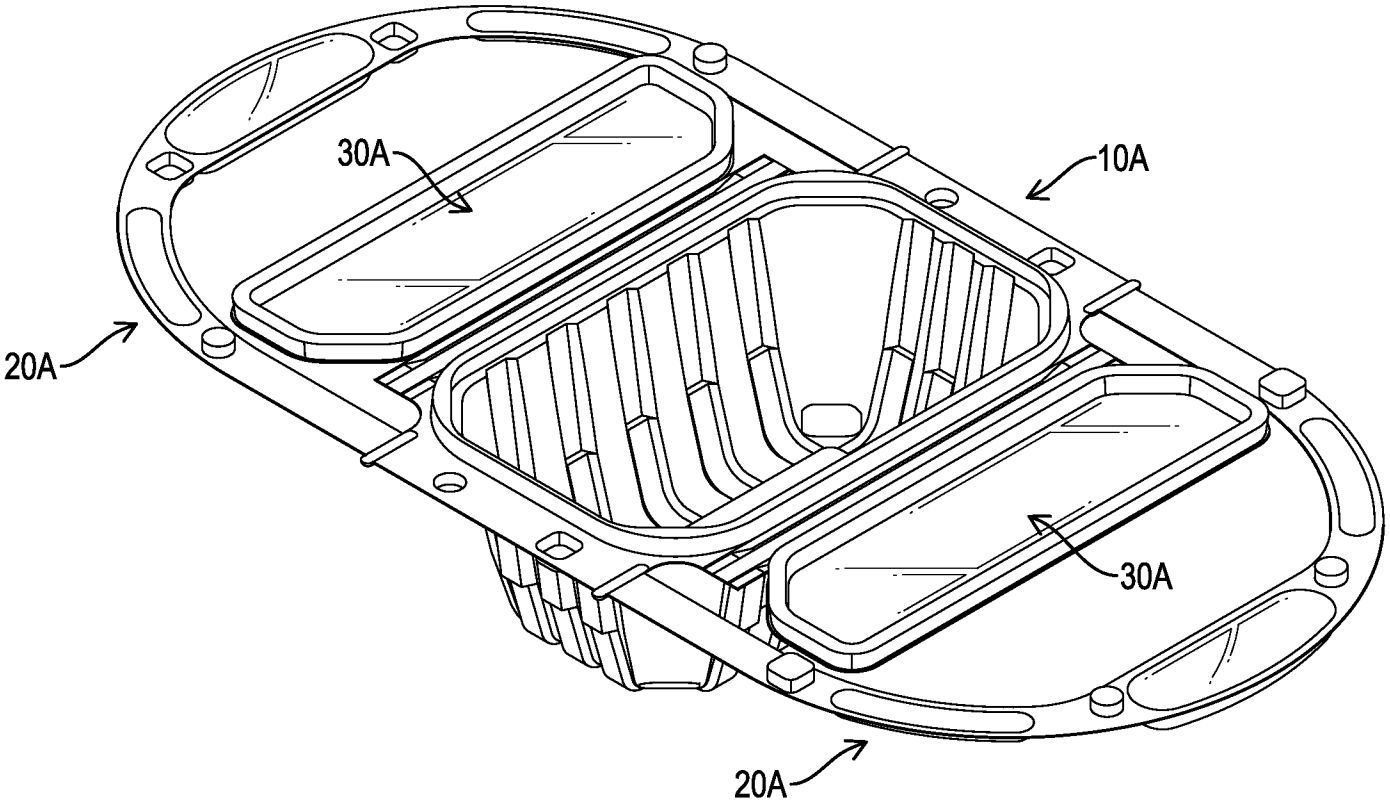
FIG. 6 is a perspective view of a second preferred embodiment of the container in accordance with the present invention.
Figure 7:
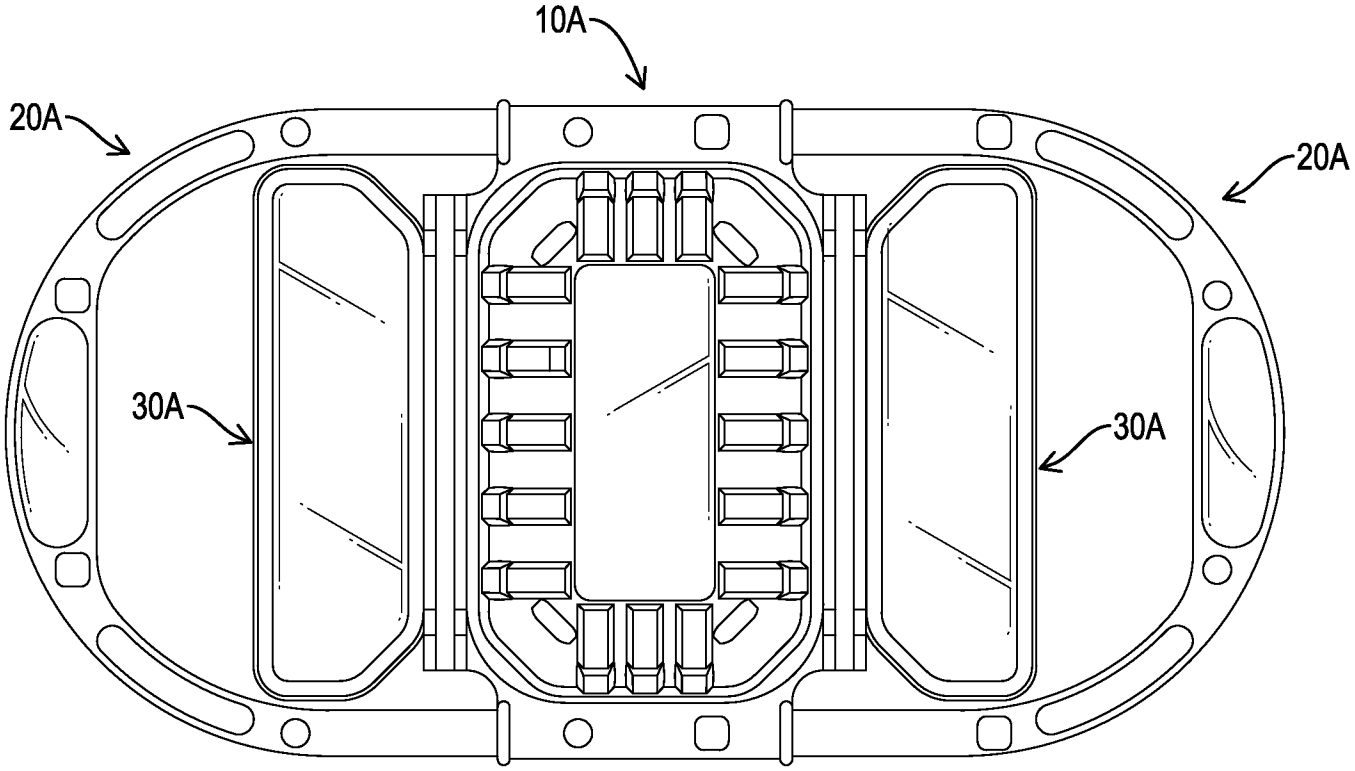
FIG. 7 is a top view of the container in FIG. 6.

A second preferred embodiment of the container is shown in FIGS. 6 and 7. The body 10A is formed as a jar. The positioning recesses are omitted, so the body 10A is suitable for placing fruit which has small volume, especially small tomatoes, grapes or strawberries. Shapes of the handles 20A and the lids 3A are also different from those of the first preferred embodiment of the container, but the method of using the container is the same.

Figure 8:
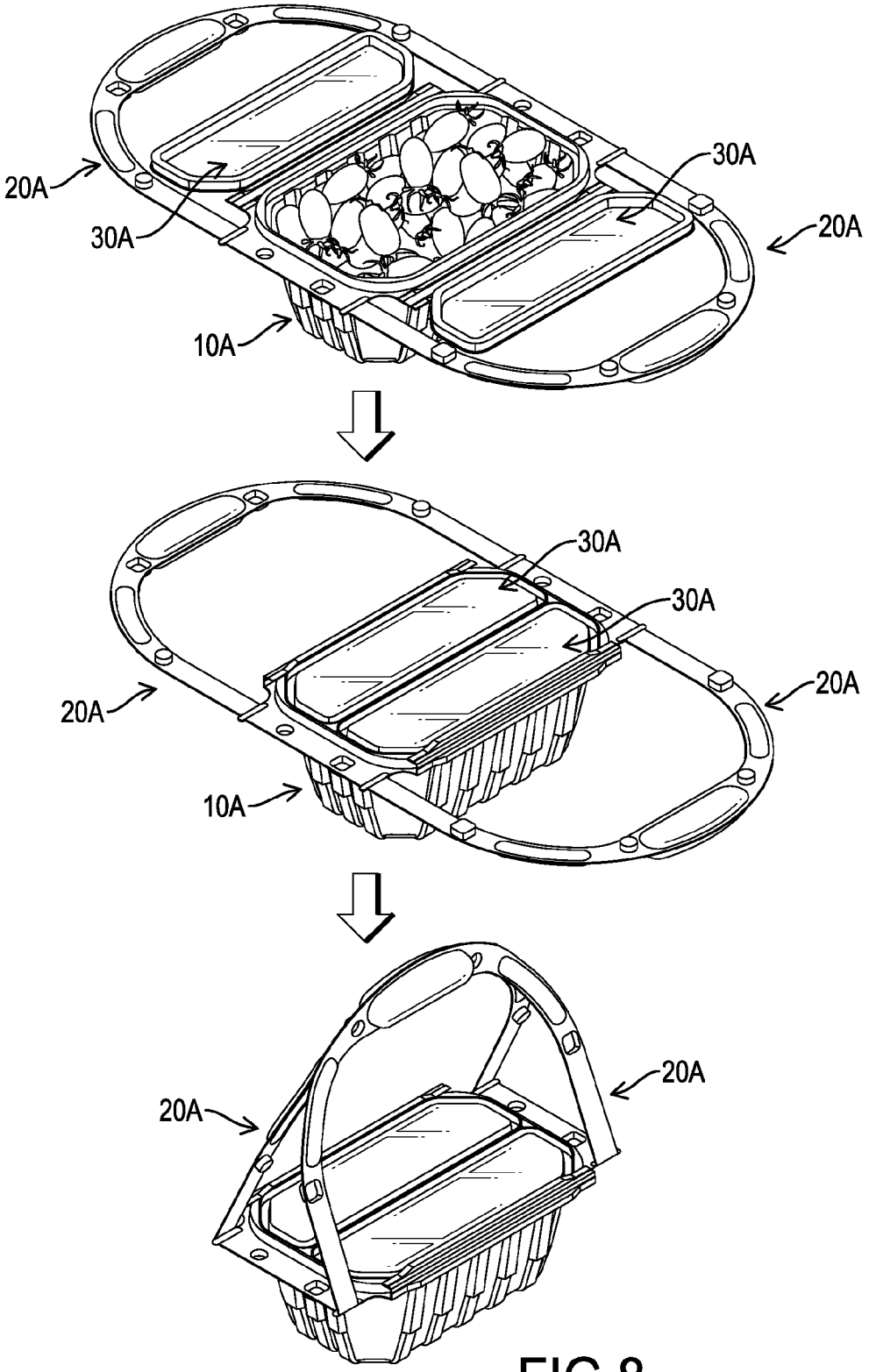
FIGS. 8 and 9 are operational views of the container in FIG. 6.

With reference to FIG. 8 after the fruit is contained in the body 10A and the lids 30A covers the body 10A, the handles 20A are bended inwardly relative to the body 10A and combined with each other by the handle combination structure to form the usage state of the container.

Figure 9:
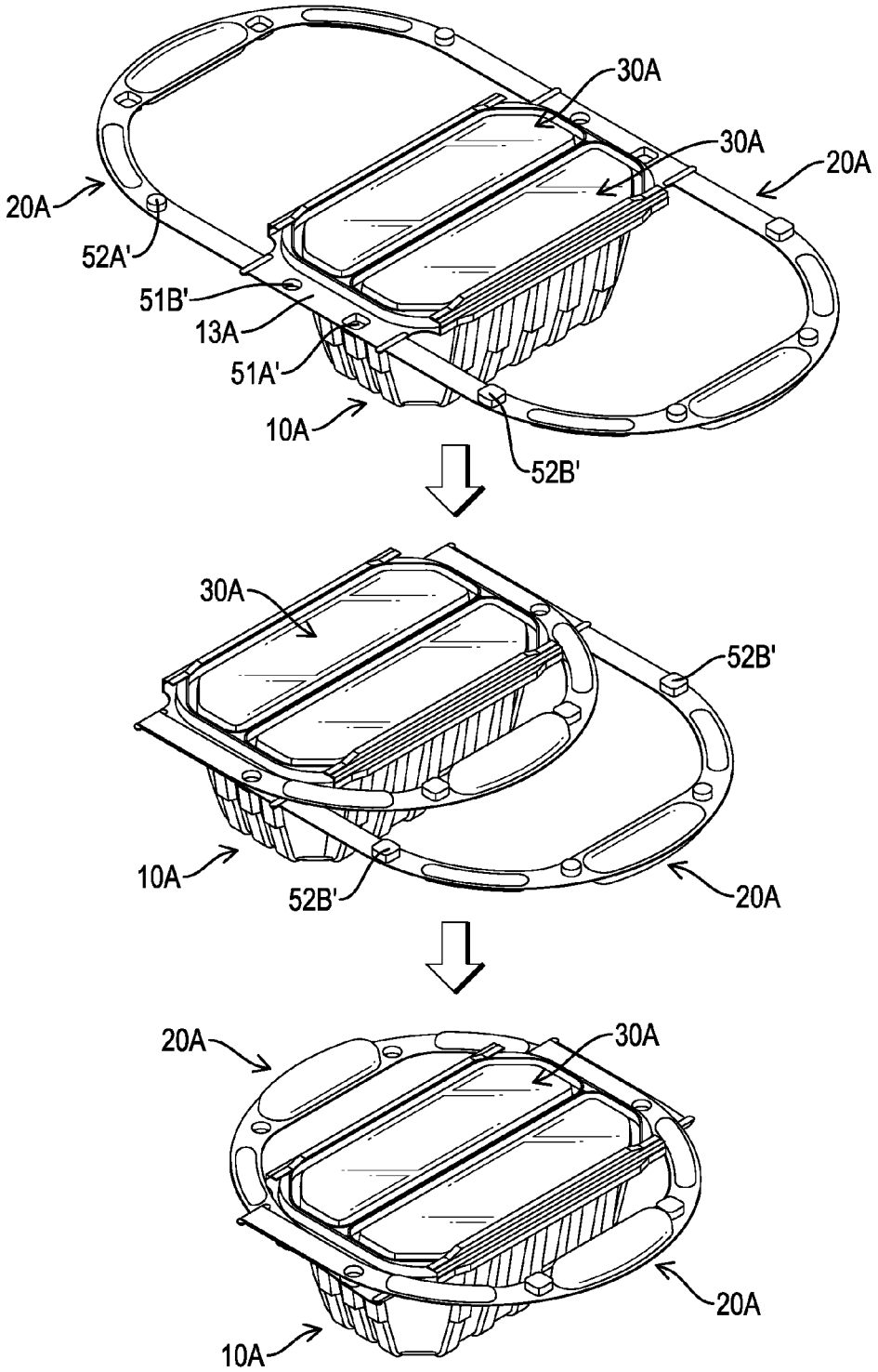
Figure 10:
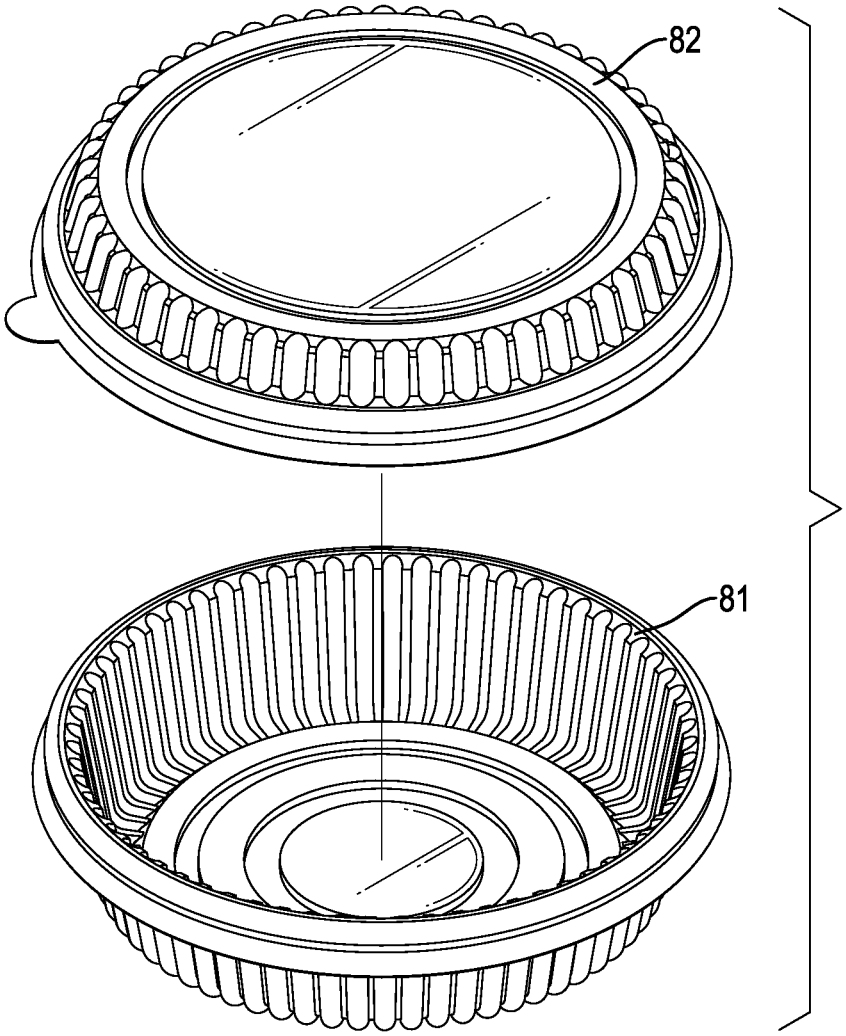
FIG.10 PRIOR ART
FIG. 10 is an exploded perspective view of a conventional container.

With reference to FIG. 9, after food is placed in the body 10A and the lids 30A cover the body 10, the handles 20A can be passed over the body 10A to form the folded usage state of the container.

From the above description, it is noted that the present invention has the following advantages: the container is integral, and comprises the handles 20 and the lids 30 which are directly connected with the body 10. When the container is manufactured, the handles 20 and the lids 30 need not be manufactured individually. In use, the lids 30 can be bended inwardly to cover the body 10. The handles 20 can be bended inwardly to form a handle structure to be carried easily. Alternatively, the handles 20 can be folded relative to the body 10 by the folding combination structure for ease in stacking and storage.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A container formed as an integral form, and comprising:

a body comprising a body space formed in the body;

two handles connected with the body, and connecting portions formed between the handles and the body and being bendable;

a handle combination structure formed on the handles to selectively combine the handles with each other;

a folding combination structure formed on the handles and the body to selectively combine the handles and the body; and two lids connected with the body, respectively located in spaces which are respectively formed between the body and the handles, and connecting portions formed between the body and the lids and being bendable, wherein the body further comprises two connecting plates, and the handles are connected with the connecting plates, and the folding combination structure is formed on the connecting plates and the handles;

the folding combination structure comprises two first plate combinational portions respectively formed on two right ends of the two connecting plates;

two second plate combinational portions respectively formed on two left ends of the two connecting plates;

two first handle combinational portions formed on the handle that is adjacent to the second plate combinational portions;

the first handle combinational portions and the first plate combinational portions are disposed equidistantly relative to connecting portions which connect the connecting plates and the handle on which the first handle combinational portions are formed; and the first handle combinational portions are selectively and respectively combined with the first plate combinational portions;

two second handle combinational portions formed on the handle that is adjacent to the first plate combinational portions, wherein the second handle combinational portions and the second plate combinational portions are disposed equidistantly relative to connecting portions which connect the connecting plates and the handle on which the second handle combinational portions are formed; and the second plate combinational portions are selectively and respectively combined with the second handle combinational portions; and the handle combination structure comprises two hand protrusions formed on one of the handles; and two hand troughs formed in the other handle, and the handle protrusions and the handle troughs combined with each other respectively and selectively.

2. A container formed as an integral form, and comprising:

a body comprising a body space formed in the body;

two handles connected with the body, and connecting portions formed between the handles and the body and being bendable;

a handle combination structure formed on the handles to selectively combine the handles with each other;

a folding combination structure formed on the handles and the body to selectively combine the handles and the body; and two lids connected with the body, respectively located in spaces which are respectively formed between the body and the handles, and connecting portions formed between the body and the lids and being bendable, wherein the body further comprises two connecting plates, and the handles are connected with the connecting plates, and the folding combination structure is formed on the connecting plates and the handles; and a lid combination structure is formed on the lids and the body to selectively combine the lids and the body.

3. A container formed as an integral form, and comprising:

a body comprising a body space formed in the body;

two handles connected with the body, and connecting portions formed between the handles and the body and being bendable;

a handle combination structure formed on the handles to selectively combine the handles with each other;

a folding combination structure formed on the handles and the body to selectively combine the handles and the body; and two lids connected with the body, respectively located in spaces which are respectively formed between the body and the handles, and connecting portions formed between the body and the lids and being bendable, wherein the body further comprises two connecting plates, and the handles are connected with the connecting plates, and the folding combination structure is formed on the connecting plates and the handles;

the folding combination structure comprises two first plate combinational portions respectively formed on two right ends of the two connecting plates;

two second plate combinational portions respectively formed on two left ends of the two connecting plates;

two first handle combinational portions formed on the handle that is adjacent to the second plate combinational portions;

the first handle combinational portions and the first plate combinational portions are disposed equidistantly relative to connecting portions which connect the connecting plates and the handle on which the first handle combinational portions are formed; and the first handle combinational portions are selectively and respectively combined with the first plate combinational portions;

two second handle combinational portions formed on the handle that is adjacent to the first plate combinational portions, wherein the second handle combinational portions and the second plate combinational portions are disposed equidistantly relative to connecting portions which connect the connecting plates and the handle on which the second handle combinational portions are formed; and the second plate combinational portions are selectively and respectively combined with the second handle combinational portions; and a lid combination structure is formed on the lids and the body to selectively combine the lids and the body.

4. The container as claimed in claim 1, wherein a lid combination structure is formed on the lids and the body to selectively combine the lids and the body.

5. The container as claimed in claim 4, wherein the lid combination structure comprises an engaging portion recessed in the body and located at a top of the body to form a top opening of the body, and two engaging flanges respectively formed on the lids and selectively combined with the engaging portion.

6. The container as claimed in claim 4, wherein the body is formed as a jar.

7. The container as claimed in claim 4, wherein the body comprises multiple positioning recesses disposed in the body space.

* * * * *